US009341994B2

(12) United States Patent
Kanehara

(10) Patent No.: US 9,341,994 B2
(45) Date of Patent: May 17, 2016

(54) IMAGE FORMING APPARATUS AND SHEET CONVEYING METHOD

(71) Applicant: BROTHER KOGYO KABUSHIKI KAISHA, Nagoya-shi, Aichi-ken (JP)

(72) Inventor: Kohei Kanehara, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/630,937

(22) Filed: Feb. 25, 2015

(65) Prior Publication Data

US 2015/0248082 A1 Sep. 3, 2015

(30) Foreign Application Priority Data

Feb. 28, 2014 (JP) ..... 2014-038961

(51) Int. Cl.
*G03G 15/16* (2006.01)
*G03G 15/02* (2006.01)

(52) U.S. Cl.
CPC ..... *G03G 15/1665* (2013.01); *G03G 15/0266* (2013.01); *G03G 15/1675* (2013.01)

(58) Field of Classification Search
CPC ..... G03G 15/1665; G03G 15/1675; G03G 15/0266; G03G 15/80
USPC ..... 399/66, 50, 314
See application file for complete search history.

(56) References Cited

U.S. PATENT DOCUMENTS

| | | | | |
|---|---|---|---|---|
| 6,731,890 | B1 * | 5/2004 | Rakov et al. | 399/66 |
| 2002/0154924 | A1 | 10/2002 | Takahashi et al. | |
| 2003/0123890 | A1 * | 7/2003 | Matsuda et al. | 399/66 |
| 2012/0106993 | A1 * | 5/2012 | Michishita | 399/66 X |
| 2013/0011155 | A1 * | 1/2013 | Ogiyama et al. | 399/66 |
| 2013/0336669 | A1 | 12/2013 | Fukami | |

FOREIGN PATENT DOCUMENTS

| | | | |
|---|---|---|---|
| JP | 2002-169385 | A | 6/2002 |
| JP | 2014-002269 | A | 1/2014 |

* cited by examiner

*Primary Examiner* — Sophia S Chen
(74) *Attorney, Agent, or Firm* — Merchant & Gould P.C.

(57) ABSTRACT

An image forming apparatus includes a belt, a cling unit, an application unit and a controller. The controller when a leading end portion of the belt where a leading end of a sheet in a conveying direction is disposed is present at a facing position where the belt and the cling unit face each other, controls the application unit to apply a clinging bias to the cling unit for supplying electric charge to the leading end portion, and when an intermediate portion of the belt disposed between the leading end portion and a trailing end portion thereof where a trailing end of the sheet is disposed is present at a facing position, reduces the clinging bias to be less than the clinging bias when the leading end portion is present at the facing position.

14 Claims, 6 Drawing Sheets

IMAGE FORMING APPARATUS AND SHEET CONVEYING METHOD

CROSS-REFERENCE TO RELATED APPLICATIONS

This application claims priority from Japanese Patent Application No. 2014-038961 filed on Feb. 28, 2014, the entire subject-matter of which is incorporated herein by reference.

TECHNICAL FIELD

The disclosure relates to a technique that supplies electric charge to a belt included in an image forming apparatus to cause a sheet to electrically cling to the belt.

BACKGROUND

There has been proposed an image forming apparatus having a function of supplying electric charge to a conveying belt to electrically cling a sheet to the conveying belt in order to stably convey the sheet. Specifically, the image forming apparatus includes a charge supply unit and a conductive ground roller, and is configured to apply a bias to the charge supply unit to supply electric charge to the conveying belt so that the sheet clings to the conveying belt at a position where the conveying belt and the conductive ground roller face each other. Further, the image forming apparatus continuously applies a constant bias to the charge supply unit over an entire period of time when a conveying portion of the belt where the entirety of the sheet is disposed is present at the facing position.

SUMMARY

Illustrative aspects of the invention provides an image forming apparatus including: a belt; a cling unit; an application unit; and a controller configured to: when a leading end portion of the belt where a leading end of a sheet in a conveying direction is disposed is present at a facing position where the belt and the cling unit face each other, control the application unit to apply a clinging bias to the cling unit for supplying electric charge to the leading end portion; and when an intermediate portion of the belt, which is disposed between the leading end portion of the belt and a trailing end portion of the belt where a trailing end of the sheet is disposed, is present at the facing position, reduce the clinging bias to be less than the clinging bias when the leading end portion is present at the facing position.

DETAILED DESCRIPTION

Figure 1:
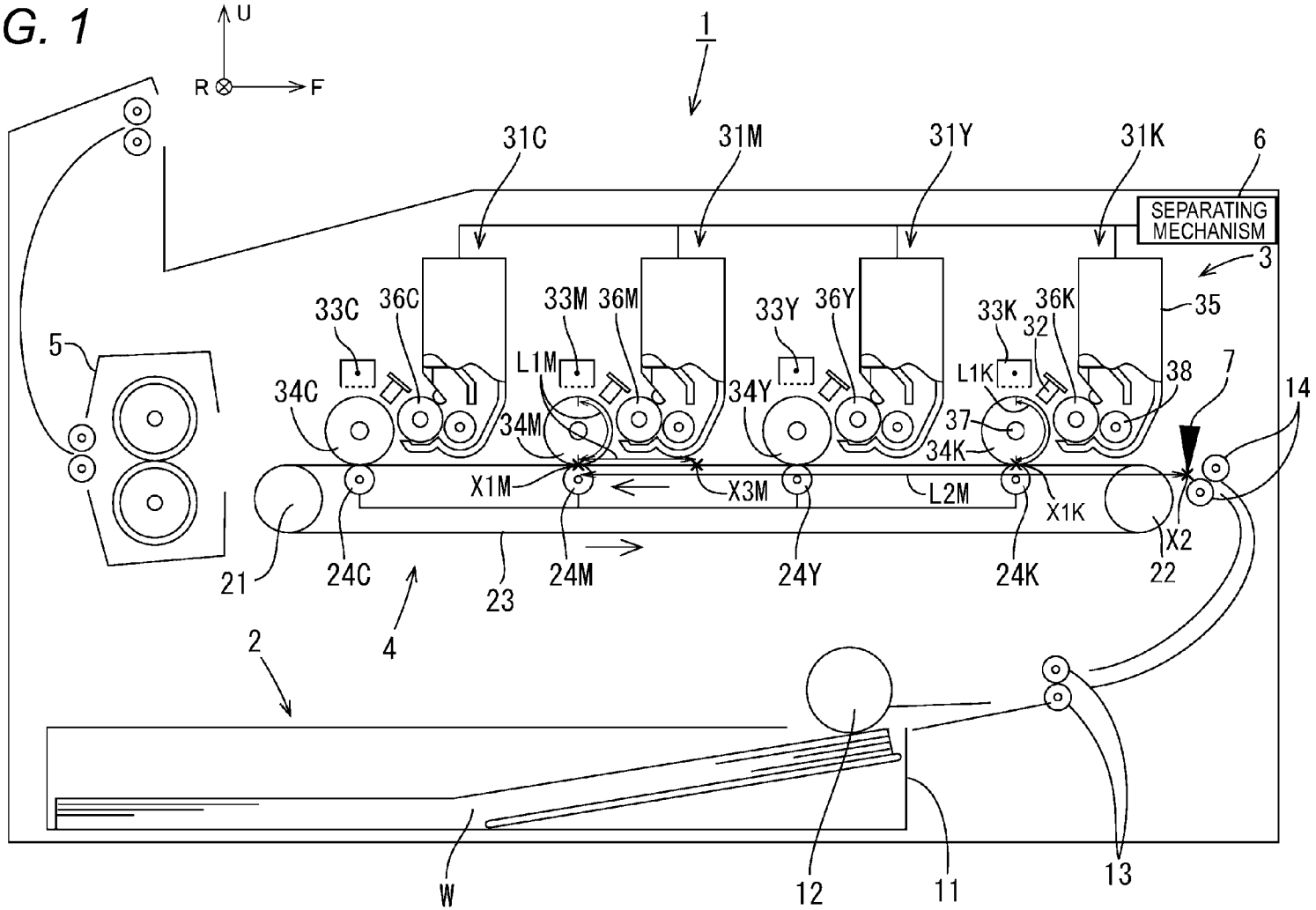
FIG. 1 is a schematic view illustrating a mechanical configuration of a printer according to an illustrative embodiment.

A printer 1 according to an illustrative embodiment will be described with reference to FIGS. 1 to 6. In the following description, it is assumed that a right side on a plane of FIG. 1 is a front side (F) of the printer 1, an inner side on the plane is a right side (R) of the printer 1, and an upper side on the plane is an upper side (U) of the printer 1. The printer 1 is a color laser printer of a direct transfer tandem type capable of forming a color image using four colors (black, yellow, magenta, and cyan), for example. In the following description, when respective components or terms of the printer 1 are distinguished for each color, K (black), Y (yellow), M (magenta), and C (cyan) indicating the respective colors are attached to ends of reference signs of the components or the like. In FIG. 1, reference signs are appropriately omitted with respect to the same component between the respective colors.

The printer 1 includes a supply unit 2, an image forming unit 3, a conveying mechanism 4, a fixing unit 5, a separating mechanism 6, and a sensor 7.

The supply unit 2 is provided in a lowermost part of the printer 1, and includes a tray 11 capable of accommodating plural sheets W, a pickup roller 12, conveying rollers 13, and registration rollers 14. The sheets W accommodated in the tray 11 are extracted by the pickup roller 12 one by one, and are sent to the conveying mechanism 4 through the conveying rollers 13 and the registration rollers 14.

The conveying mechanism 4 is a device that conveys the sheets W, and has a configuration in which a belt 23 is stretched between a drive roller 21 and a driven roller 22. If the drive roller 21 rotates, a surface of the belt 23 on a side that faces a photosensitive drum 34 moves in a left side in FIG. 1. Thus, the sheet W sent from the registration rollers 14 is conveyed to the fixing unit 5 from the image forming unit 3. The belt 23 is formed of a conductive material. Inside the belt 23, four transfer rollers 24K to 24C (to be described later) are arranged along the conveying direction of the sheet W, that is, in a horizontal direction.

The image forming unit 3 includes four processing sections 31K to 31C, and four exposing sections 32. The four processing sections 31K to 31C are arranged in the conveying direction. Since the four processing sections 31K to 31C have the same configuration except for toner colors, a specific configuration thereof will be described hereinafter using the processing section 31K corresponding to black as an example.

The processing section 31K includes a transfer roller 24K, a charger 33K, a photosensitive drum 34K, a case 35, a developing roller 36K, and a supply roller 38.

The photosensitive drum 34K rotates around a rotational axis 37. The photosensitive drum 34K has a configuration in which a positively chargeable photosensitive layer is formed on a base made of aluminum. The charger 33K is a scorotron type charger or a corotron type charger, for example. If a printing charging bias VC1 of positive polarity (to be described later), or the like is applied to the charger 33K, the charger 33K uniformly electrifies a surface of the photosensitive drum 34K.

The exposing section 32 includes plural light emitting elements (for example, LEDs) that are arranged in a row along a rotational axis direction of the photosensitive drum 34K. The plural light emitting elements are controlled to emit light according to image data corresponding to a print command (which is to be described later), so that an electrostatic latent image is formed on the surface of the photosensitive drum 34K. The exposing section 32 is not limited to the LED type, and may be a polygon scanning type or the like.

The case 35K stores a positively chargeable toner of each color, for example. The supply roller 38 supplies the toner in the case 35K to the developing roller 36K while rotating. Thus, the toner is frictionally charged to be positive between the supply roller 38K and the developing roller 36K. Then, the developing roller 36K supplies the positively charged toner onto the photosensitive drum 34K to develop the electrostatic latent image, to thereby form a black toner image on the photosensitive drum 34K.

The transfer roller 24K is arranged to face the photosensitive drum 34K via the belt 23. Hereinafter, a position where the transfer roller 24K and the belt 23 face each other is referred to as a transfer position X1K. Further, hereinafter, a distance from a charging position where the charger 33K electrifies the photosensitive drum 34K to the transfer position X1K (to be described later) in the rotational direction of the photosensitive drum 34 is referred to as a charging transfer distance L1K. As a transfer bias VT1 of reverse polarity (here, negative polarity) to the charging polarity of the toner is applied between the photosensitive drum 34K and the transfer roller 24K, the transfer roller 24K transfers the toner image formed on the photosensitive drum 34 to the sheet W.

The sheet W on which the toner images of the respective colors are transferred in this way is conveyed to the fixing unit 5 by the conveying mechanism 4. Then, the toner images are thermally fixed by the fixing unit 5, and the sheet W is discharged onto an upper surface of the printer 1.

The separating mechanism 6 individually displaces four processing sections 31K to 31C under the control of the CPU 41. Specifically, the separating mechanism 6 may displace each processing section 31 between a developable position where the developing roller 36 comes into contact with or comes close to the photosensitive drum 34 to be able to supply the toner (see FIG. 1) and an undevelopable position where the developing roller 36 is separated from the photosensitive drum 34 to be unable to supply the toner.

The sensor 7 outputs a detection signal according to the presence or absence of the sheet W in a detection position X2 between the registration rollers 14 and the conveying mechanism 4. A timing when each processing section 31 writes an image on the sheet W is determined based on a detection timing of a leading end of the sheet W in the sensor 7. Hereinafter, a distance from the detection position X2 to the transfer position X1 is referred to as a detection transfer position L2.

Figure 2:
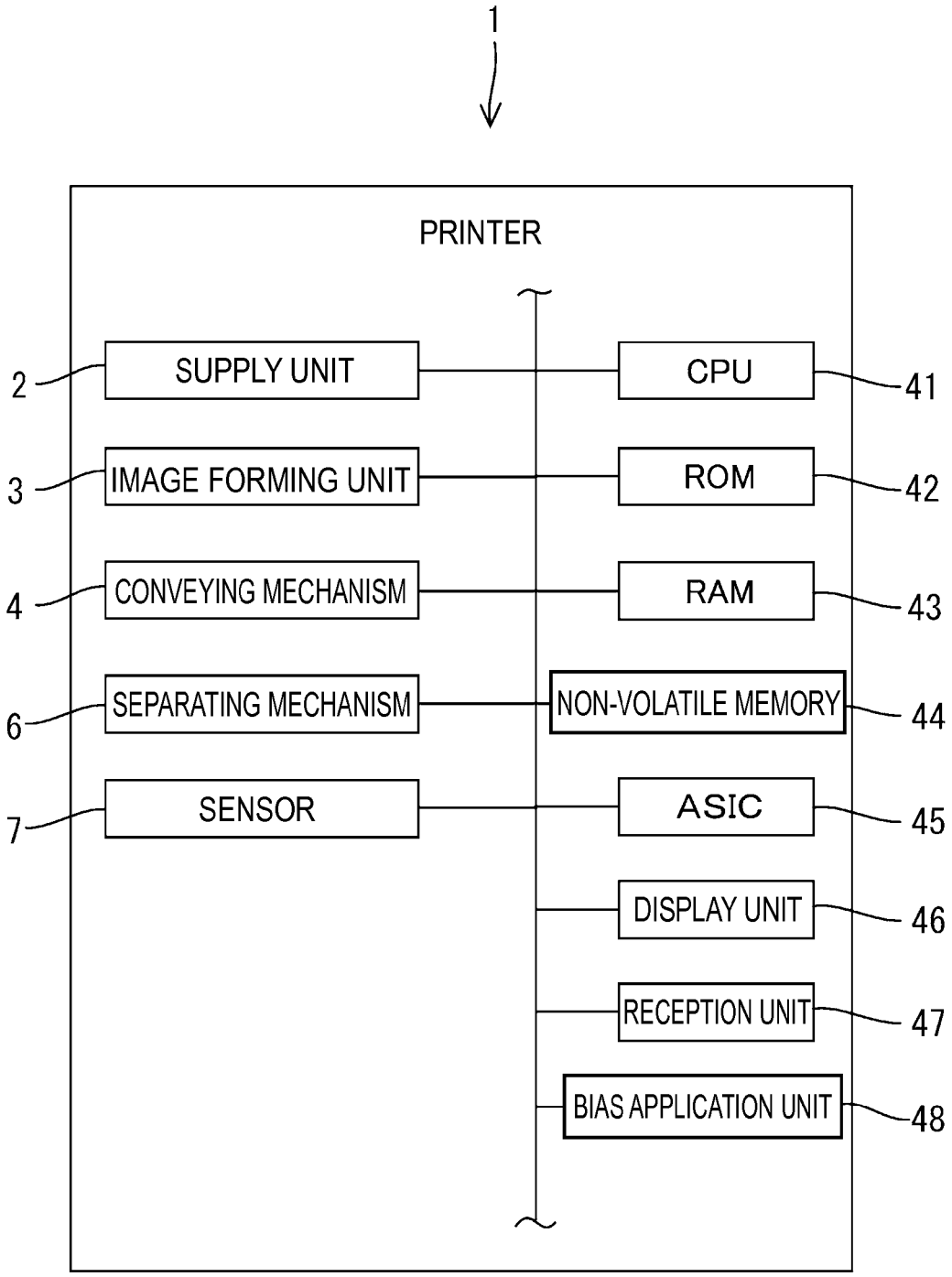
FIG. 2 is a block diagram illustrating an electric configuration of the printer.

As shown in FIG. 2, the printer 1 includes a central processing unit (hereinafter, referred to as CPU) 41, a ROM 42, a RAM 43, a non-volatile memory 44, an application specific integrated circuit (ASIC) 45, a display unit 46, a reception unit 47, and a bias application unit 48, in addition to the above-described supply unit 2, the image forming unit 3, the conveying mechanism 4, the separating mechanism 6, the sensor 7, and the like.

Various programs are stored in the ROM 42. The various programs include a program for executing a control process (to be described later) or the like, or a program for controlling operations of the respective units of the printer 1, for example. The RAM 43 is used as a work area when the CPU 41 executes the various programs, or a temporary data storage area. The non-volatile memory 44 may be a rewritable memory such as a NAVRAM, a flash memory, an HDD, or an EPPROM.

The CPU 41 controls the respective units of the printer 1 according to the program read from the ROM 42. The ASIC 45 is a hardware circuit dedicated to image processing, for example. The display unit 46 includes a liquid crystal display, a lamp, or the like, and is able to display various setting screens, operation states of the apparatus, or the like. The reception unit 47 includes plural buttons, and serves as an operation unit capable of receiving various input instructions from a user, and a communication unit that performs communication with an external apparatus (not shown) by a wireless communication method or a wired communication method.

The bias application unit 48 applies a developing bias to the developing roller 36, applies a bias VC such as the printing charging bias VC1 to the charger 33, and applies a bias VT such as the transfer bias VT1 to the transfer roller 24. Further, the bias application unit 48 is able to change bias values of the respective biases VC and VT under the control of the CPU 41.

Figure 3:
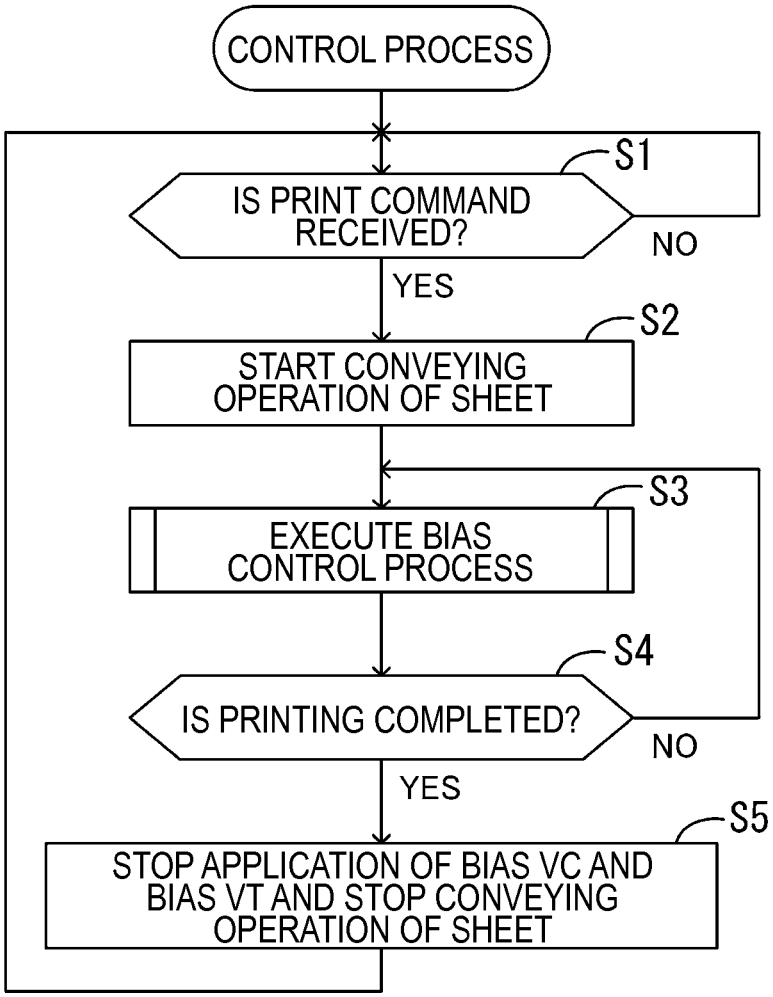
FIG. 3 is a flowchart illustrating a control process.

Control content executed by the CPU 41 will be described with reference to FIGS. 3 to 6. If the power of the printer 1 is turned on, as shown in FIG. 3, the CPU 41 determines whether the reception unit 47 receives a print command (S1). It is assumed that the print command includes information about designation indicating whether the print command relates to color printing or monochrome printing or the number of sheets to be printed.

When it is determined that the print command is not received (S1: NO), the CPU 41 waits, and when it is determined that the print command is received (S1: YES), the CPU 41 controls the supply unit 2 and the conveying mechanism 4 to start the operation of conveying the sheet W stored in the tray 11 (S2). Then, the CPU 41 executes a bias control process (S3).

The bias control process will be described with reference to FIG. 4. The bias control process is a process that is individually executed with respect to each of the processing sections 31K to 31C by the CPU 41, and is a process of determining which bias is applied to the transfer roller 24 and the charger 33 included in each processing section 31. Hereinafter, the bias control process will be described using the magenta processing section 31M as an example.

The CPU 41 determines whether the transfer roller 24M satisfies an execution condition of a clinging process (S11 and S12). It is assumed that the execution condition is that the transfer roller 24M is not a printing process usage target based on the print command and is disposed on an upstream side in the conveying direction with reference to another transfer roller 24 which is a printing process usage target.

Specifically, the CPU 41 determines whether the transfer roller 24M is the printing process usage target (S11). If the color printing is designated in the print command, the CPU 41 determines that the transfer roller 24M is the printing process usage target. On the other hand, if the monochrome printing is designated in the print command, the CPU 41 determines that the transfer roller 24M is not the printing process usage target.

If it is determined that the transfer roller 24M is the printing process usage target (S11: YES), the CPU 41 controls the processing section 31M to execute a forming process of forming a magenta toner image on the sheet W. That is, since the transfer roller 24M does not satisfy the execution condition of the clinging process, the clinging process is not executed with respect to the transfer roller 24M.

Figure 6:
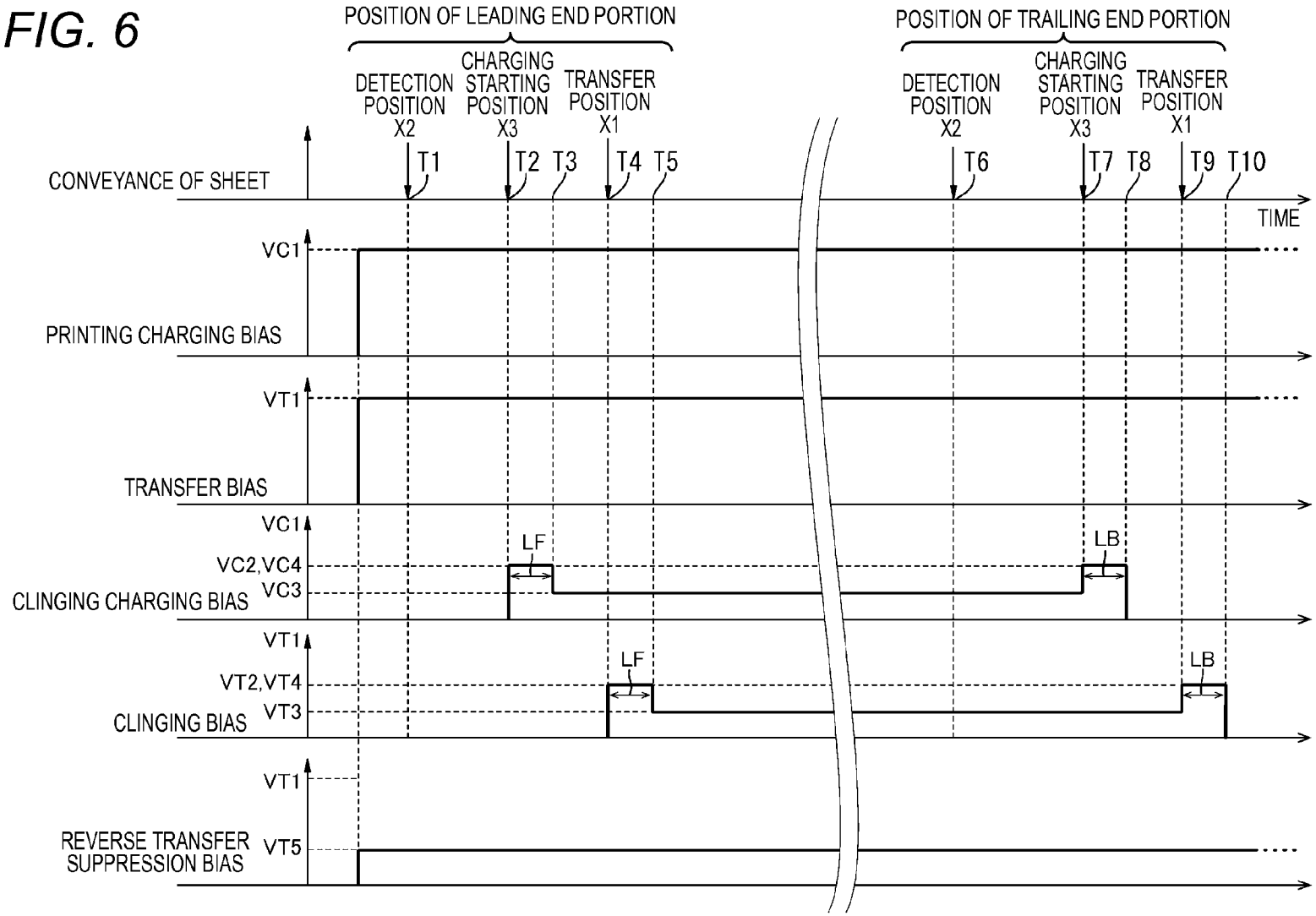
FIG. 6 is a time chart illustrating the relationship between a conveying position of a sheet and a bias.

Specifically, as shown in a second time chart from the top in FIG. 6, the CPU 41 controls the bias application unit 48 to start an operation of applying the above-described printing charging bias VC1 to the charger 33M (S15). The printing charging bias VC1 has a size capable of charging the surface of the photosensitive drum 34M to such a degree that the toner from the developing roller 36M is not attached thereto, which is 5 kV to 8 kV, for example.

Further, as shown in a third time chart from the top in FIG. 6, the CPU 41 controls the bias application unit 48 to start an operation of applying the above-described transfer bias VT1 to the transfer roller 24M (S15). The transfer bias VT1 has a size capable of transferring the image formed on the photosensitive drum 34M onto the sheet W, which is −8 kV, for example. In FIG. 6, an example in which the CPU 41 starts the process of S15, for example, before the leading end of the sheet W in the conveying direction reaches the detection position X2, is shown. However, the invention is not limited thereto, and the CPU 41 may start the process of S15 before the leading end of the sheet W reaches the transfer position X1M after passing through the detection position X2.

Next, the CPU 41 controls the exposing section 32 to form an electrostatic latent image on the surface of the charged photosensitive drum 34M (S16). Then, the electrostatic latent image is developed by the developing roller 36M to which the developing bias is applied to become the magenta toner image. Further, the toner image is transferred onto the sheet W by the transfer roller 24M to which the transfer bias VT1 is applied (S16).

After execution of the process of S16, the CPU 41 proceeds to S4 in FIG. 3 while maintaining the printing charging bias VC1 and the transfer bias VT1 in preparation for a printing process with respect to the next sheet W.

Figure 4:
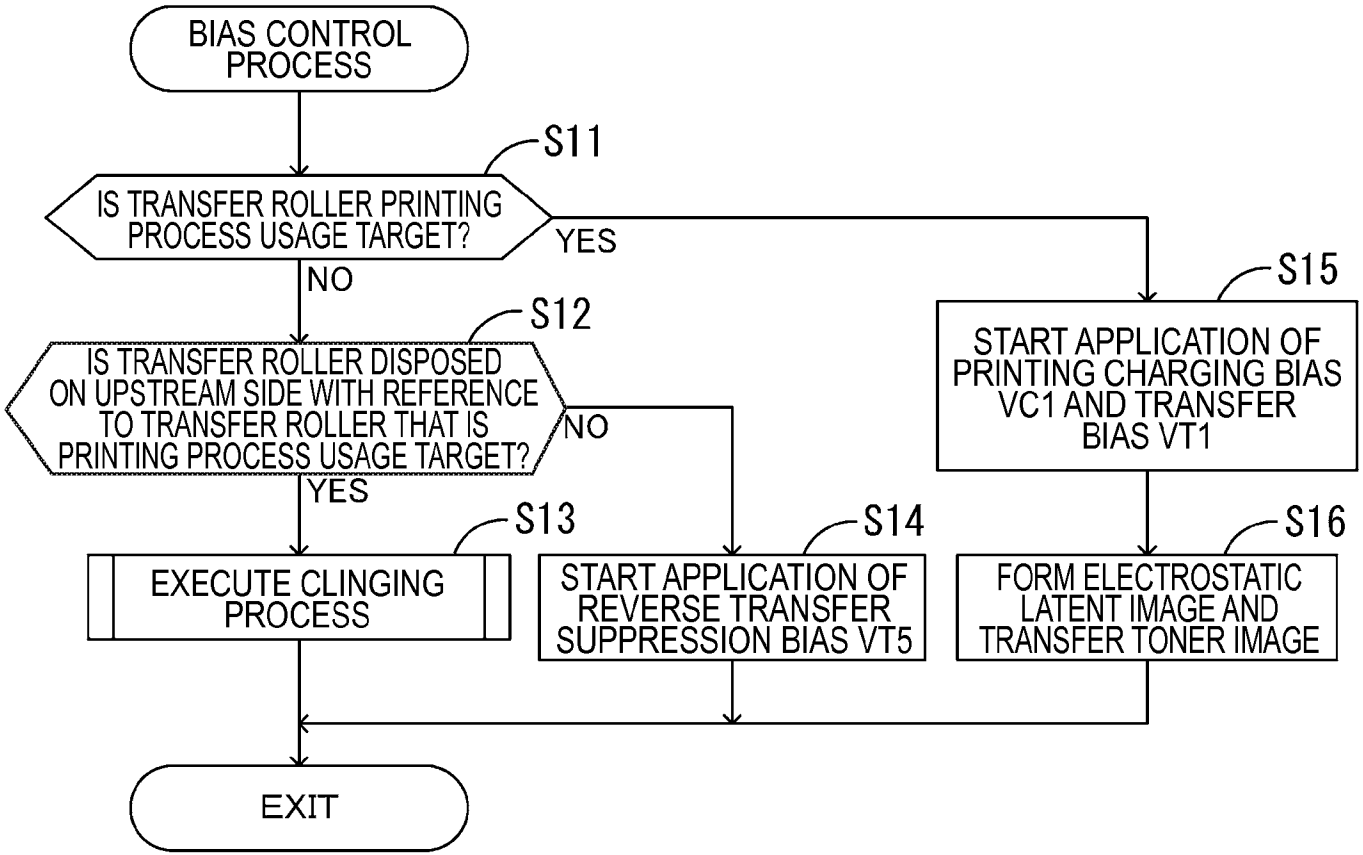
FIG. 4 is a flowchart illustrating a bias control process.

In S11 of FIG. 4, if it is determined that the transfer roller 24M is not the printing process usage target (S11: NO), the CPU 41 determines whether this transfer roller 24M is disposed on the upstream side in the conveying direction with reference to the transfer roller 24 which is the printing process usage target (S12). For example, if only the transfer roller 24C is the printing process usage target, the transfer roller 24M satisfies the execution condition of the clinging process, and thus, the CPU 41 determines that the determination result is affirmative (S12: YES), and accordingly executes the clinging process (S13).

The clinging process will be described with reference to FIG. 5. The CPU 41 controls the separating mechanism 6 to perform an operation of displacing the developing roller 36M to the undevelopable position (S21). Thus, it is possible to prevent the magenta toner image from being attached to the photosensitive drum 34M and the sheet W.

Then, the CPU 41 determines whether a leading end portion of the belt 23 where the leading end of the sheet W is assumed to be disposed reaches a charging starting position X3M (S22). Here, the leading end portion refers to a portion of the belt 23 corresponding to a width LF from a leading end of a conveying portion where the entirety of the sheet W is disposed, and a trailing end portion of the belt 23 refers to a portion thereof corresponding to a width LB from a trailing end of the conveying portion toward the leading end thereof. The charging starting position X3M is a position on an upstream side by a charging transfer distance L1M with reference to the transfer position X1M, as shown in FIG. 1. Specifically, the CPU 41 determines whether the leading end of the sheet W reaches the detection position X2 based on the detection signal from the sensor 7.

Further, the CPU 41 determines whether the conveying mechanism 4 conveys the sheet W by a distance (=L2M−L1M) obtained by subtracting the charging transfer distance L1M from a detection transfer distance L2M from a time point when the leading end of the sheet W reaches the detection position X2 (see T1 in FIG. 6). The CPU 41 may determine whether the conveying mechanism 4 conveys the sheet W by each distance based on the number of steps given to a stepping motor which is a drive source of the conveying mechanism 4, a conveying time, or the like.

When the conveying mechanism 4 does not convey the sheet W by the distance (=L2M−L1M), the CPU 41 determines that the leading end portion does not reach the charging starting position X3M (S22: NO), and waits. On the other hand, when the conveying mechanism 4 conveys the sheet W by the distance (=L2M−L1M), the CPU 41 determines that the leading end portion reaches the charging starting position X3M (S22: YES). Accordingly, as shown in a fourth time chart from the top in FIG. 6, the CPU 41 controls the bias application unit 48 to start an operation of applying a leading end charging bias VC2 to the charger 33M (S23, see T2 in FIG. 6).

Thus, in the clinging process, compared with a case where the photosensitive drum 34M that faces the transfer roller 24M to which a leading end clinging bias VT2 (to be described later) or the like is applied is not charged, it is possible to suppress deterioration of the photosensitive drum 34M. The leading end charging bias VC2 may be equal to or less than the printing charging bias VC1 in absolute value, and may have a size capable of causing the sheet W to electrically cling to the belt 23. Here, if the leading end charging bias VC2 is less than the printing charging bias VC1, it is possible to suppress power consumption compared with a case where the leading end charging bias VC2 is the same as the printing charging bias VC1.

The CPU 41 determines whether the leading end portion passes through the charging starting position X3M after the application of the leading end charging bias VC2 is started (S24). Specifically, when the conveying mechanism 4 does not convey the sheet W by the width LF of the leading end portion in the conveying direction from the time when it is determined that the leading end portion reaches the charging starting position X3M (S22: YES), the CPU 41 determines that the leading end portion does not pass through the charging starting position X3M (S24: NO), and waits.

On the other hand, when the conveying mechanism 4 conveys the sheet W by the width LF from the time when it is determined that the leading end portion reaches the charging starting position X3M (S22: YES), the CPU 41 determines that the leading end portion passes through the charging starting position X3M (S24: YES). Accordingly, as shown in the fourth time chart from the top in FIG. 6, the CPU 41 switches the operation so that the bias application unit 48 applies an intermediate charging bias VC3 to the charger 33M (S25, see T3 in FIG. 6). The intermediate charging bias VC3 may be equal to or less than the leading end charging bias VC2 in absolute value. Further, in S25, the CPU 41 may control the bias application unit 48 to stop the application of the bias to the charger 33M.

The CPU 41 determines whether the leading end portion reaches the transfer position X1M after the application of the intermediate charging bias VC3 is started (S26). Specifically, when the conveying mechanism 4 does not convey the sheet W by the detection transfer distance L2M from the time when it is determined that the leading end of the sheet W reaches the detection position X2, the CPU 41 determines that the leading end portion does not reach the transfer position X1M (S26: NO), and waits.

On the other hand, when the conveying mechanism 4 conveys the sheet W by the detection transfer distance L2M from the time when it is determined that the leading end of the sheet W reaches the detection position X2, the CPU 41 determines that the leading end portion reaches the transfer position X1M (S26: YES). Accordingly, as shown in a fifth time chart from the top in FIG. 6, the CPU 41 controls the bias application unit 48 to start an operation of applying the leading end clinging bias VT2 to the transfer roller 24M (S27, see T4 in FIG. 6). Thus, the belt 23 is supplied with negative electric charge so that a leading end side of the sheet W electrically clings to the belt 23.

The leading end clinging bias VT2 has a size capable of causing the sheet W to electrically cling to the belt 23, which may be equal to or less than the transfer bias VT1 in absolute value. Here, in the latter case, compared with the leading end clinging bias VT2 is the same as the transfer bias VT1, it is possible to suppress power consumption.

The CPU 41 determines whether the leading end portion passes through the transfer position X1M after the application of the leading end clinging bias VT2 is started (S28). Specifically, when the conveying mechanism 4 does not convey the sheet W by the width LF from the time when it is determined that the leading end portion reaches the transfer position X1M (S26: YES), the CPU 41 determines that the leading end portion does not pass through the transfer position X1M (S28: NO), and waits.

On the other hand, when the conveying mechanism 4 conveys the sheet W by the width LF from the time when it is determined that the leading end portion reaches the transfer position X1M (S26: YES), the CPU 41 determines that the leading end portion passes through the transfer position X1M (S28: YES). Accordingly, as shown in the fifth time chart from the top in FIG. 6, the CPU 41 switches the operation so that the bias application unit 48 applies an intermediate clinging bias VT3 to the transfer roller 24M (S29, see T5 in FIG. 6).

The intermediate clinging bias VT3 is less than the leading end clinging bias VT2 in absolute value.

After the application of the intermediate clinging bias VT3 is started, the CPU 41 determines whether the trailing end portion of the belt 23 where the trailing end of the sheet W is assumed to be disposed reaches the charging starting position X3M (S30). Specifically, the CPU 41 determines whether the trailing end of the sheet W reaches the detection position X2 based on the detection signal from the sensor 7.

Further, the CPU 41 determines whether the conveying mechanism 4 conveys the sheet W by a distance (=L2M−L1M−LB) obtained by subtracting the charging transfer distance L1M and the width LB of the trailing end portion from the detection transfer distance L2M from the time when it is determined that the trailing end of the sheet W reaches the detection position X2 (see T6 in FIG. 6). The width LB of the trailing end portion may be equal to or shorter than the width LF of the leading end portion.

When the conveying mechanism 4 does not convey the sheet W by the distance (L2M−L1M−LB), the CPU 41 determines that the trailing end portion does not reach the charging starting position X3M (S30: NO), and waits. On the other hand, when the conveying mechanism 4 conveys the sheet W by the distance (L2M−L1M−LB), the CPU 41 determines that the trailing end portion reaches the charging starting position X3M (S30: YES). Accordingly, as shown in the fourth time chart from the top in FIG. 6, the CPU 41 controls the bias application unit 48 to start an operation of applying a trailing end charging bias VC4 to the charger 33M (S31, see T7 in FIG. 6). In the present illustrative embodiment, an absolute value of the trailing end charging bias VC4 is greater than an absolute value of the intermediate charging bias VC3.

Thus, in the clinging process, compared with a case where the photosensitive drum 34M that faces the transfer roller 24M to which a trailing end clinging bias VT4 (to be described later) or the like is applied is not charged, it is possible to suppress deterioration of the photosensitive drum 34M. The trailing end charging bias VC4 may be equal to or less than the printing charging bias VC1 in absolute value, and may be less than the leading end charging bias VC2 in absolute value. That is, the trailing end charging bias VC4 may have any size capable of causing the sheet W to electrically cling to the belt 23. Here, if the trailing end charging bias VC4 is less than the printing charging bias VC1 or the leading end charging bias VC2, it is possible to suppress power consumption.

The CPU 41 determines whether the trailing end portion passes through the charging starting position X3M after the application of the trailing end charging bias VC4 is started (S32). Specifically, when the conveying mechanism 4 does not convey the sheet W by the width LB from the time when it is determined that the trailing end portion reaches the charging starting position X3M (S30: YES), the CPU 41 determines that the trailing end portion does not pass through the charging starting position X3M (S32: NO), and waits.

On the other hand, when the conveying mechanism 4 conveys the sheet W by the width LB from the time when it is determined that the trailing end portion reaches the charging starting position X3M (S30: YES), the CPU 41 determines that the trailing end portion passes through the charging starting position X3M (S32: YES). Accordingly, as shown in the fourth time chart from the top in FIG. 6, the CPU 41 controls the bias application unit 48 to stop the operation of applying the bias VC to the charger 33M (S33, see T8 in FIG. 6).

After the bias VC is stopped, the CPU 41 determines whether the trailing end portion reaches the transfer position X1M (S34). Specifically, when the conveying mechanism 4 does not convey the sheet W by a distance (=L2M−LB) obtained by subtracting the width LB of the trailing end portion from the detection transfer distance L2M from the time when it is determined that the trailing end of the sheet W reaches the detection position X2, the CPU 41 determines that the trailing end portion does not reach the transfer position X1M (S34: NO), and waits.

On the other hand, when the conveying mechanism 4 conveys the sheet W by the distance (=L2M−LB) from the time when it is determined that the trailing end of the sheet W reaches the detection position X2, the CPU 41 determines that the trailing end portion reaches the transfer position X1M (S34: YES). Accordingly, as shown in the fifth time chart from the top in FIG. 6, the CPU 41 controls the bias application unit 48 to start an operation of applying the trailing end clinging bias VT4 to the transfer roller 24M (S35, see T9 in FIG. 6). In the present illustrative embodiment, an absolute value of the trailing end clinging bias VT4 is greater than the absolute value of the intermediate clinging bias VT3. Thus, since the trailing end side of the sheet W electrically clings to the belt 23, compared with a case where the trailing end portion is not charged, it is possible to stably convey the sheet.

The trailing end clinging bias VT4 has a size capable of causing the sheet W to electrically cling to the belt 23, which may be equal to or less than the transfer bias VT1 in absolute value, and may be less than the leading end clinging bias VT2 in absolute value. Here, if the trailing end clinging bias VT4 is less than the transfer bias VT1, it is possible to suppress power consumption.

The CPU 41 determines whether the trailing end portion passes through the transfer position X1M after the application of the trailing end clinging bias VT4 is started (S36). Specifically, when the conveying mechanism 4 does not convey the sheet W by the width LB from the time when it is determined that the trailing end portion reaches the transfer position X1M (S34: YES), the CPU 41 determines that the trailing end portion does not pass through the transfer position X1M (S36: NO), and waits.

On the other hand, when the conveying mechanism 4 conveys the sheet W by the width LB from the time when it is determined that the trailing end portion reaches the transfer position X1M (S34: YES), the CPU 41 determines that the trailing end portion passes through the transfer position X1M (S36: YES). Accordingly, as shown in the fifth time chart from the top in FIG. 6, the CPU 41 controls the bias application unit 48 to stop the operation of applying the bias VT to the transfer roller 24M (S37, see T10 in FIG. 6), and then, proceeds to S4 in FIG. 3.

Here, as described above, when the leading end portion reaches the charging starting position X3M (S22: YES), the application of the leading end charging bias VC2 to the charger 33M is started (S23), and when the leading end portion reaches the transfer position X1M (S26: YES), the application of the leading end clinging bias VT2 to the transfer roller 24M is started (S27). That is, a charged range of the photosensitive drum 34M and the leading end portion reach the transfer position X1M at approximately the same time.

Further, when the trailing end portion passes through the charging starting position X3M (S32: YES), the application of the bias VC to the charger 33M is stopped (S33), and when the trailing end portion passes through the transfer position X1M (S36: YES), the application of the bias VT to the transfer roller 24M is stopped (S37). That is, a charged range of the photosensitive drum 34M and the trailing end portion pass through the transfer position X1M at approximately the same time. Thus, it is possible to appropriately overlap the charged range of the photosensitive drum 34M and the charged range of the belt 23 at the transfer position X1M, and thus, it is possible to more effectively suppress power consumption to be used in the clinging process.

In S11 and S12 of FIG. 4, if it is determined that the transfer roller 24M is not the printing process usage target and is not disposed on the upstream side in the conveying direction with reference to the transfer roller 24 that is the printing process usage target (S11: NO and S12: NO), the CPU 41 executes a reverse transfer suppression process.

Specifically, as shown in a sixth time chart from the top in FIG. 6, the CPU 41 controls the bias application unit 48 to start an operation of applying a reverse transfer suppression bias VT5 to the transfer roller 24M (S14). The reverse transfer suppression bias VT5 may be equal to or less than the transfer bias VT1 or the clinging biases VT2 to VT4 in absolute value, and may have any size capable of preventing the toner from being attached to the photosensitive drum 34M from the sheet W.

Thus, for example, when the transfer rollers 24K and 24Y on the upstream side with reference to the transfer roller 24M are the transfer roller 24 which is the printing process usage target, it is possible to prevent the toner transferred to the sheet W by the upstream transfer rollers 24K and 24Y from being reversely transferred to the photosensitive drum 34M. Further, for example, the transfer roller 24C on a downstream side with reference to the transfer roller 24M is the transfer roller 24 which is the printing process usage target, and when the transfer rollers 24K and 24Y on the upstream side with reference to the transfer roller 24M are the transfer roller 24 which is the printing process usage target, it is possible to prevent the toner transferred to the sheet W by the upstream transfer rollers 24K and 24Y from being reversely transferred to the photosensitive drum 34M. After executing the process of S14, the CPU 41 proceeds to S4 in FIG. 3.

In S4 of FIG. 3, the CPU 41 determines whether the printing process for the sheets corresponding to the number of sheets to be printed designated by the print command is completed. If it is determined that the printing process is not completed (S4: NO), the CPU 41 returns to S3, and then, starts the bias control process with respect to the next sheet W. On the other hand, if it is determined that the printing process is completed (S4: YES), the CPU 41 controls the bias application unit 48 to stop the application of the biases VC and VT, and controls the conveying mechanism 4 to stop the conveying operation of the sheet W (S5), and returns to S1.

In the intermediate portion of the belt 23, the sheet does not become easily unstable compared with the leading end portion, and thus, the necessity of supplying electric charge thereto by a clinging bias having the same size as in the leading end portion is low. Thus, according to the present illustrative embodiment, when the intermediate portion is at the transfer position X1, the clinging bias becomes small, compared with a case where the leading end portion is at the transfer position X1. Thus, it is possible to stably convey the sheet while suppressing power consumption compared with a configuration in which a constant clinging bias is applied over the entire length of the conveying portion of the belt.

Further, the clinging process is executed with respect to the transfer roller 24 which is not the printing process usage target (see S11 in FIG. 4). Thus, it is possible to stably convey the sheet while transferring the toner image to the sheet W by a part of the transfer rollers 24 and suppressing power consumption by the remaining part of the transfer rollers 24.

Further, the clinging process is executed with respect to the transfer roller 24 that is disposed on the upstream side with reference to the transfer roller 24 which is the printing process usage target (see S12 in FIG. 4). Thus, it is possible to stabilize the conveyance of the sheet W by the upstream transfer roller 24, and then, to transfer the toner image to the sheet by the downstream transfer roller 24.

The technique disclosed in this specification is not limited to the illustrative embodiment described in the above description and the drawings, and includes the following various aspects, for example.

An "image forming apparatus" is not limited to the color laser printer of the direct transfer tandem type, and for example, may be an image forming apparatus of a different type such as an intermediate transfer type or a four cycle type. Further, the image forming apparatus is not limited to the color image forming apparatus, and may be an image forming apparatus dedicated to monochrome. Further, the image forming apparatus may be an electrophotographic type other than the polygon scanning type, for example, an LED type or the like. Further, the image forming apparatus may be an ink jet type. In addition, the image forming apparatus may be a printer single body, a copier machine, a facsimile machine, or a complex machine.

Further, the printer 1 has a configuration in which the printing is performed using the positively chargeable toner, but is not limited thereto, and may have a configuration in which the printing is performed using a negatively chargeable toner. In this case, the bias VC becomes negative and the bias VT becomes positive.

An "image carrier" is not limited to a photoreceptor such as the photosensitive drum 34, and may be an intermediate transfer object or the like.

A "cling unit" is not limited to a transfer member, and may be a clinging roller and a charge supplying unit that are disposed to face the belt 23.

Figure 5:
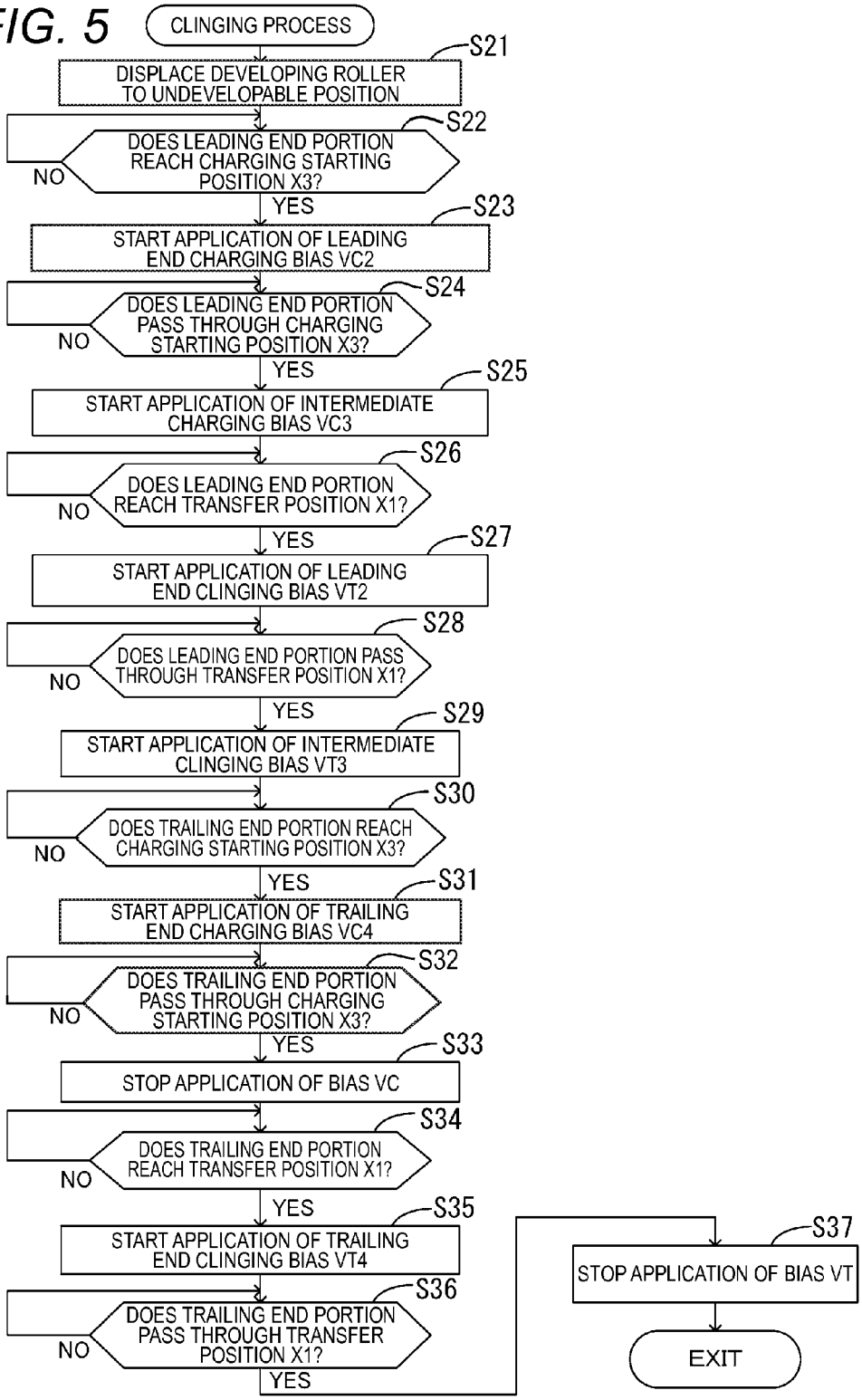
FIG. 5 is a flowchart illustrating a clinging process.

A "controller" has a configuration in which the respective units in FIGS. 3 to 5 are executed by one CPU 41. However, the controller is not limited thereto, and may have a configuration in which the respective units in FIG. 3 or the like are executed by plural CPUs, a configuration in which the respective units in FIG. 3 or the like are executed only by an exclusive hardware circuit such as the ASIC 45, or a configuration in which the respective units in FIG. 3 or the like are executed by the CPU and the hardware circuit.

In the bias process of FIG. 4, if it is determined that the processing section 31K corresponding to black is not the printing process usage target (S11: NO), the CPU 41 may proceed to S13 without executing the process of S12. Further, if it is determined that the processing section 31C corresponding to cyan is not the printing process usage target (S11: NO), the CPU 41 may proceed to S14 without executing the process of S12.

In the bias process of FIG. 4, if it is determined that the transfer roller 24M is not the printing process usage target (S11: NO), the CPU 41 may proceed to S13 without executing the step S12. Further, the clinging process executing condition is not limited to the condition of S11 and S12, and for example, may be a condition that a transfer roller that is disposed on the most upstream side, among all of the transfer rollers 24K to 24C, is used. Further, when there are plural transfer rollers 24 that satisfy the clinging process executing condition, the CPU 41 may not execute the clinging process with respect to all the transfer rollers. For example, the CPU 41 may execute the clinging process with respect to only the upstream transfer roller 24 where the conveyance of the sheet W easily becomes unstable, among the plural transfer rollers 24 that satisfy the clinging process executing condition.

Since the sheet W is supplied with electric charge by the transfer roller 24 disposed on the upstream side in the conveying direction, although a clinging force due to the clinging bias is weakened in the transfer roller 24 disposed on the downstream side, the conveyance of the sheet W does not easily become unstable. Thus, when there are plural transfer rollers 24 that satisfy the clinging process executing condition, the CPU 41 may perform at least one of a process of reducing the clinging biases VT2 to VT4 and a process of narrowing the range of the belt 23 supplied with the electric charge by the clinging biases VT2 to VT4, as the transfer roller 24 is disposed on the downstream side. Thus, it is possible to stably convey the sheet while suppressing power consumption.

The leading end processing and the intermediate processing, that is, the clinging process in FIG. 5, may be executed when the reception unit 47 does not receive the print command. For example, when an error occurs in the printer 1, the sheet W may be conveyed and discharged without executing the printing process. In such a case, the clinging process may be executed. In this case, the CPU 41 may proceed to S13 without executing the processes of S11 and S12.

In the clinging process in FIG. 5, the CPU 41 may proceed to S22 without executing the process of S21.

In S29 in FIG. 5, the CPU 41 may control the bias application unit 48 to stop the application of the bias to the transfer roller 24M. This is because in the intermediate portion of the sheet W, a possibility that the conveyance thereof becomes unstable, for example, due to winding onto the transfer roller 24, is low, compared with the leading end or the trailing end thereof. Thus, it is possible to more effectively suppress power consumption.

In S14 in FIG. 4, only when the conveying portion of the belt 23 where the entirety of the sheet W is disposed, or a part thereof passes through the transfer position X1, the bias application unit 48 may apply the reverse transfer suppression bias VT5 to the transfer roller 24M. Further, in S14, the bias application unit 48 may apply the bias VC to the charger 33M.

In the clinging process of FIG. 5, the bias application unit 48 may not apply the bias VC to the charger 33M corresponding to the transfer roller 24M. This is because even though the clinging bias VT2 or the like is applied to the transfer roller 24M, deterioration of the photosensitive drum 34M can be suppressed by a resistance component of the sheet W. Thus, it is possible to suppress deterioration of the photosensitive drum 34M while suppressing power consumption, compared with the bias VC being applied to the charger 33M.

What is claimed is:

1. An image forming apparatus comprising:

a belt;

a cling unit;

an application unit; and a controller configured to:

when a leading end portion of the belt where a leading end of a sheet in a conveying direction is disposed is present at a facing position where the belt and the cling unit face each other, control the application unit to apply a clinging bias to the cling unit for supplying electric charge to the leading end portion; and when an intermediate portion of the belt, which is disposed between the leading end portion of the belt and a trailing end portion of the belt where a trailing end of the sheet is disposed, is present at the facing position, reduce the clinging bias to be less than the clinging bias when the leading end portion is present at the facing position; and a first image carrier, wherein the cling unit comprises a first transfer member that faces the first image carrier via the belt, wherein the controller is configured to control the application unit to apply a transfer bias to the first transfer member for transferring a toner image formed on the first image carrier to the belt, and wherein the clinging bias, when the leading end portion is present at the facing position, is less than the transfer bias.

2. The image forming apparatus according to claim 1, further comprising:

the first image carrier and a second image carrier which are arranged along the conveying direction, wherein the cling unit comprises:

the first transfer member that faces the first image carrier via the belt; and a second transfer member that faces the second image carrier via the belt, wherein the controller is configured to control the application unit to apply a transfer bias to the first transfer member for transferring a toner image formed on the first image carrier to the belt, and wherein with respect to the second transfer member, the controller is configured to:

when the leading end portion of the belt where the leading end of the sheet in the conveying direction is disposed is present at the facing position where the belt and the cling unit face each other, control the application unit to apply the clinging bias to the cling unit for supplying the electric charge to the leading end portion; and when the intermediate portion of the belt which is disposed between the leading end portion of the belt and the trailing end portion of the belt where the trailing end of the sheet is disposed, is present at the facing position, reduce the clinging bias to be less than the clinging bias when the leading end portion is present at the facing position.

3. The image forming apparatus according to claim 2, wherein the second transfer member is disposed on an upstream side in the conveying direction with reference to the first transfer member.

4. The image forming apparatus according to claim 3, wherein when a conveying portion of the belt where an entirety of the sheet is disposed is present at a facing position where a third transfer member and the belt face each other, the third transfer member being disposed on a downstream side in the conveying direction with reference to the first transfer member, the controller is configured to control the application unit to apply a bias, which is equal to or less than the transfer bias, to the third transfer member.

5. The image forming apparatus according to claim 2, further comprising:

a first charger corresponding to the first transfer member; and a second charger corresponding to the second transfer member, wherein the controller is configured to control the application unit to apply a charging bias to the second charger for charging the second image carrier.

6. The image forming apparatus according to claim 2, further comprising:

a plurality of chargers corresponding to a plurality of the transfer members, wherein the controller is configured to control the application unit not to apply a charging bias to a second charger corresponding to the second transfer member.

7. The image forming apparatus according to claim 2, wherein when a conveying portion of the belt where an entirety of the sheet is disposed is present at a facing position where the second transfer member and the belt face with each other, the facing position being disposed on a downstream side in the conveying direction with reference to the first transfer member, the controller is configured to control the application unit to apply a bias, which is equal to or less than the transfer bias to the second transfer member.

8. The image forming apparatus according to claim 1, wherein when the trailing end portion of the belt where the trailing end of the sheet in the conveying direction is disposed is present at the facing position, the controller is configured to control the application unit to apply a clinging bias, which is greater than the clinging bias when the intermediate portion is present at the facing position, to the cling unit for supplying electric charge to the trailing end portion.

9. The image forming apparatus according to claim 1, wherein the controller is configured to control the application unit to stop the application of the clinging bias to the cling unit when the intermediate portion is present at the facing position.

10. The image forming apparatus according to claim 1, wherein the controller is configured to, when the intermediate portion of the belt is present at the facing position, control the application unit to apply the clinging bias, which is less than the clinging bias when the leading end portion of the belt has present at the facing position, to the cling unit for supplying the electric charge to the intermediate portion of the belt.

11. The image forming apparatus according to claim 1, wherein the controller is configured to:

in response to the leading end portion of the belt arriving at the facing position, control the application unit to apply a first clinging bias to the cling unit for supplying electric charge to the leading end portion of the belt; and in response to the leading end portion of the belt having passed the facing position, control the application unit to apply a second clinging bias, which is less than the first clinging bias, to the intermediate portion of the belt.

12. An image forming apparatus comprising:

a belt;

a cling unit;

an application unit;

a controller configured to:

when a leading end portion of the belt where a leading end of a sheet in a conveying direction is disposed is present at a facing position where the belt and the cling unit face each other, control the application unit to apply a clinging bias to the cling unit for supplying electric charge to the leading end portion; and when an intermediate portion of the belt, which is disposed between the leading end portion of the belt and a trailing end portion of the belt where a trailing end of the sheet is disposed, is present at the facing position, reduce the clinging bias to be less than the clinging bias when the leading end portion is present at the facing position;

a first image carrier and a second image carrier which are arranged along the conveying direction;

a first charger corresponding to a first transfer member; and a second charger corresponding to a second transfer member, wherein the cling unit comprises:

the first transfer member that faces the first image carrier via the belt; and the second transfer member that faces the second image carrier via the belt, wherein the controller is configured to control the application unit to apply a transfer bias to the first transfer member for transferring a toner image formed on the first image carrier to the belt, and wherein with respect to the second transfer member, the controller is configured to:

when the leading end portion of the belt where the leading end of the sheet in the conveying direction is disposed is present at the facing position where the belt and the cling unit face each other, control the application unit to apply the clinging bias to the cling unit for supplying the electric charge to the leading end portion; and when the intermediate portion of the belt which is disposed between the leading end portion of the belt and the trailing end portion of the belt where the trailing end of the sheet is disposed, is present at the facing position, reduce the clinging bias to be less than the clinging bias when the leading end portion is present at the facing position, wherein the controller is configured to control the application unit to apply a charging bias to the first charger and the second charger for charging the first image carrier and the second image carrier, and wherein the charging bias applied to the second charger is less than the charging bias applied to the first charger.

13. An image forming apparatus comprising:

a belt;

a cling unit;

an application unit;

a controller configured to:

when a leading end portion of the belt where a leading end of a sheet in a conveying direction is disposed is present at a facing position where the belt and the cling unit face each other, control the application unit to apply a clinging bias to the cling unit for supplying electric charge to the leading end portion; and when an intermediate portion of the belt, which is disposed between the leading end portion of the belt and a trailing end portion of the belt where a trailing end of the sheet is disposed, is present at the facing position, reduce the clinging bias to be less than the clinging bias when the leading end portion is present at the facing position;

a first image carrier and a second image carrier which are arranged along the conveying direction;

a first charger corresponding to a first transfer member; and a second charger corresponding to a second transfer member, wherein the cling unit comprises:

the first transfer member that faces the first image carrier via the belt; and the second transfer member that faces the second image carrier via the belt, wherein the controller is configured to control the application unit to apply a transfer bias to the first transfer member for transferring a toner image formed on the first image carrier to the belt, and wherein with respect to the second transfer member, the controller is configured to:

when the leading end portion of the belt where the leading end of the sheet in the conveying direction is disposed is present at the facing position where the belt and the cling unit face each other, control the application unit to apply the clinging bias to the cling unit for supplying the electric charge to the leading end portion; and when the intermediate portion of the belt which is disposed between the leading end portion of the belt and the trailing end portion of the belt where the trailing end of the sheet is disposed, is present at the facing position, reduce the clinging bias to be less than the clinging bias when the leading end portion is present at the facing position, wherein the controller is configured to control the application unit to apply a charging bias to the second charger for charging the second image carrier, and wherein the controller is configured to control the application unit such that a charged range of the second image carrier overlaps with a portion of the belt supplied with electric charge by the second transfer member at the facing position.

14. An image forming apparatus comprising:

a belt;

a cling unit;

an application unit;

a controller configured to:

when a leading end portion of the belt where a leading end of a sheet in a conveying direction is disposed is present at a facing position where the belt and the cling unit face each other, control the application unit to apply a clinging bias to the cling unit for supplying electric charge to the leading end portion; and when an intermediate portion of the belt, which is disposed between the leading end portion of the belt and a trailing end portion of the belt where a trailing end of the sheet is disposed, is present at the facing position, reduce the clinging bias to be less than the clinging bias when the leading end portion is present at the facing position;

a first image carrier and a second image carrier which are arranged along the conveying direction; and a third image carrier that is arranged in parallel with the first image carrier and the second image carrier along the conveying direction, the third image carrier being disposed on a downstream side in the conveying direction with reference to the second image carrier, wherein the cling unit comprises:

a first transfer member that faces the first image carrier via the belt;

a second transfer member that faces the second image carrier via the belt; and a third transfer member that faces the third image carrier via the belt, wherein the controller is configured to control the application unit to apply a transfer bias to the first transfer member for transferring a toner image formed on the first image carrier to the belt, wherein with respect to the second transfer member, the controller is configured to:

when the leading end portion of the belt where the leading end of the sheet in the conveying direction is disposed is present at the facing position where the belt and the cling unit face each other, control the application unit to apply the clinging bias to the cling unit for supplying the electric charge to the leading end portion; and when the intermediate portion of the belt which is disposed between the leading end portion of the belt and the trailing end portion of the belt where the trailing end of the sheet is disposed, is present at the facing position, reduce the clinging bias to be less than the clinging bias when the leading end portion is present at the facing position, and wherein with respect to the third transfer member, the controller is configured to:

when the leading end portion of the belt where the leading end of the sheet in the conveying direction is disposed is present at a facing position where the belt and the third transfer member face each other, control the application unit to apply a clinging bias to the third transfer member for supplying electric charge to the leading end portion;

when the intermediate portion of the belt disposed between the leading end portion thereof and the trailing end portion thereof where the trailing end of the sheet is disposed is present at the facing position, reduce the clinging bias to be less than the clinging bias when the leading end portion is present at the facing position; and perform at least one of a process of reducing the clinging bias of the third transfer member to be less than the clinging bias of the second transfer member, and a process of narrowing a range of the third transfer member supplied with electric charge by the clinging bias to be less than a range of the second transfer member supplied with electric charge by the clinging bias.

* * * * *